United States Patent [19]

Collins et al.

[11] 4,441,047

[45] Apr. 3, 1984

[54] ELECTROSTATIC SILICA COATING FOR ELECTRIC LAMPS

[75] Inventors: Clifford B. Collins, Euclid; William G. James, Cleveland Heights, both of Ohio

[73] Assignee: General Electric Company, Schenectady, N.Y.

[21] Appl. No.: 328,040

[22] Filed: Dec. 7, 1981

[51] Int. Cl.[3] ..... H01K 1/32
[52] U.S. Cl. ..... 313/116
[58] Field of Search ..... 313/116

[56] References Cited

U.S. PATENT DOCUMENTS 4,081,709 3/1978 Collins et al. ..... 313/116
4,099,080 7/1978 Dawson et al. ..... 313/116

*Primary Examiner*—Palmer C. Demeo
*Attorney, Agent, or Firm*—John F. McDevitt; Philip L. Schlamp; Fred Jacob

[57] ABSTRACT

A silica powder mixture is disclosed for electrostatic deposition to provide diffuse light from electric lamps. The present powder mixture exhibits improved moisture resistance along with shelf life and comprises in weight proportions approximately 35–65 parts calcined diatomaceous silica, approximately 35–65 parts fumed silica, and approximately 5–15 parts colloidal hydrophobic silica.

6 Claims, 3 Drawing Figures

DESCRIPTION OF THE PREFERRED EMBODIMENTS

Figure 1:
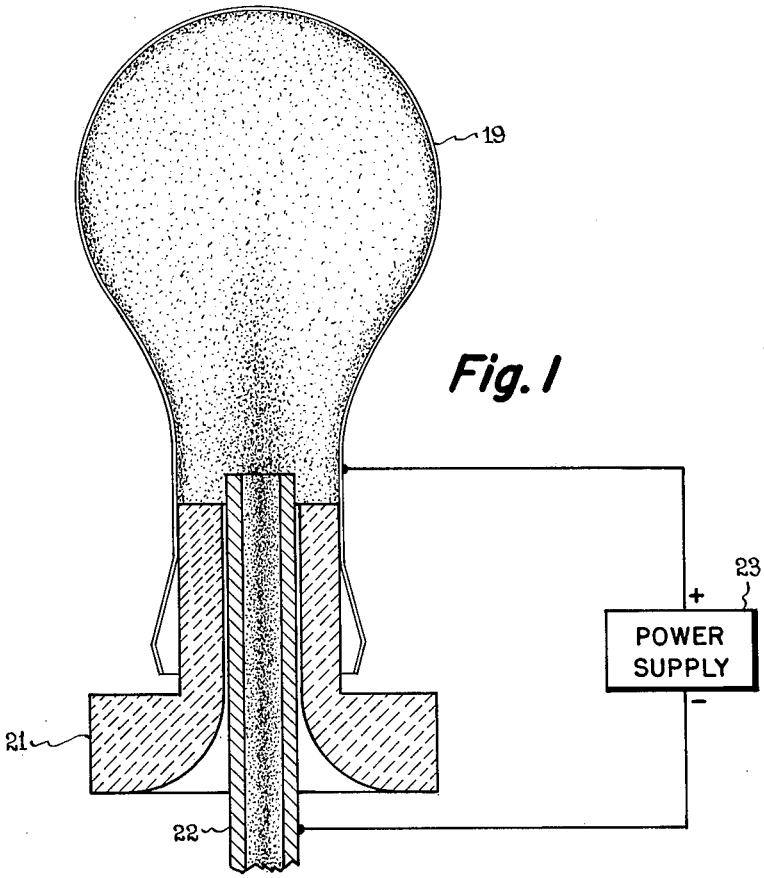
FIG. 1 depicts the method of electrostatically coating the powder mixtures of the present invention.

As depicted in FIG. 1 and also described more fully in the aforementioned 4,081,709 patent, the lamp glass bulb 19 while suspended in a suitable holding device such as a chuck 21 is equipped with a supply tube 22 which supplies the powder mixture to the inner surface of the bulb wall. The supply tube 22 conveys a mixture of air and powder from a reservoir (not shown) to the interior of the bulb with the air pressure in the tube being higher than that in the bulb. Bulb 19 is heated to electrical conductance at approximately 160°-170° C. or higher, and the high voltage from a supply source 23 is applied between supply tube 22 and the bulb 19. The power supply 23 typically provides an output voltage of 20-35 kilovolts to the charging corona point. It is preferred that supply tube 22 be grounded and the bulb 19 be positive to simplify construction of the coating apparatus. In accordance with said coating method, the above designated especially preferred coating mixture of the present invention was applied by being blown through the supply tube into the bulb picking up a negative charge as it passed the corona point and then being attracted to the positively charged bulb where it was deposited to form the light diffusion coating.

The charging and powder depositing steps in the present coating process are affected by the electrical conductivity of the powder mixture. If the powder is too conductive, it becomes difficult to charge at the corona point and when the powder reaches the bulb, the charge is lost so quickly that the particles of powder are not compacted into an adherent coating but simply reside on the surface as loose particles. Accordingly, if the powder conductivity exceeds an acceptable range, as hereinafter more fully described, the deposited coating lacks adherence. Powder conductivity below the acceptable range results in different coating problems. The charge on the powder in the coating is retained because of low conductivity and part of the residual charge can thereafter be dissipated by arcing to the glass bulb wall leaving a small pinhole with the powder piled up around it like a crater. These are known as voltage pinholes which can best be seen by lighting a lamp. Additionally, the charge built up on the coating with low conductivity powder will repel additional particles of charged powder so that it may prove difficult to achieve a coating thickness sufficient to hide the filament or other internal lamp structure. Applying more powder does increase the coating thickness but produces loose powder deposited on the coating. Weight of deposited coating needed to hide the filament or other internal lamp structure also increases as a result since the coating is now too compacted for effective light scattering.

Another serious problem is encountered if the deposited powder coating contains excess moisture when the lamp is manufactured. More particularly, moisture is prevented from escape within the sealed lamp glass envelope which can lead to a "water cycle" effect such as by attacking a filament in an incandescent-type lamp during the lamp operation. Residual excess moisture in the conventional silica coatings applied on said incandescent lamps now requires compensation in the form of additional gettering or more elevated exhaust temperatures during the lamp manufacture. Both forms of compensation understandably increase the manufacturing costs since the higher exhaust temperatures can also require supplemental water cooling during the lamp manufacture.

Figure 2:
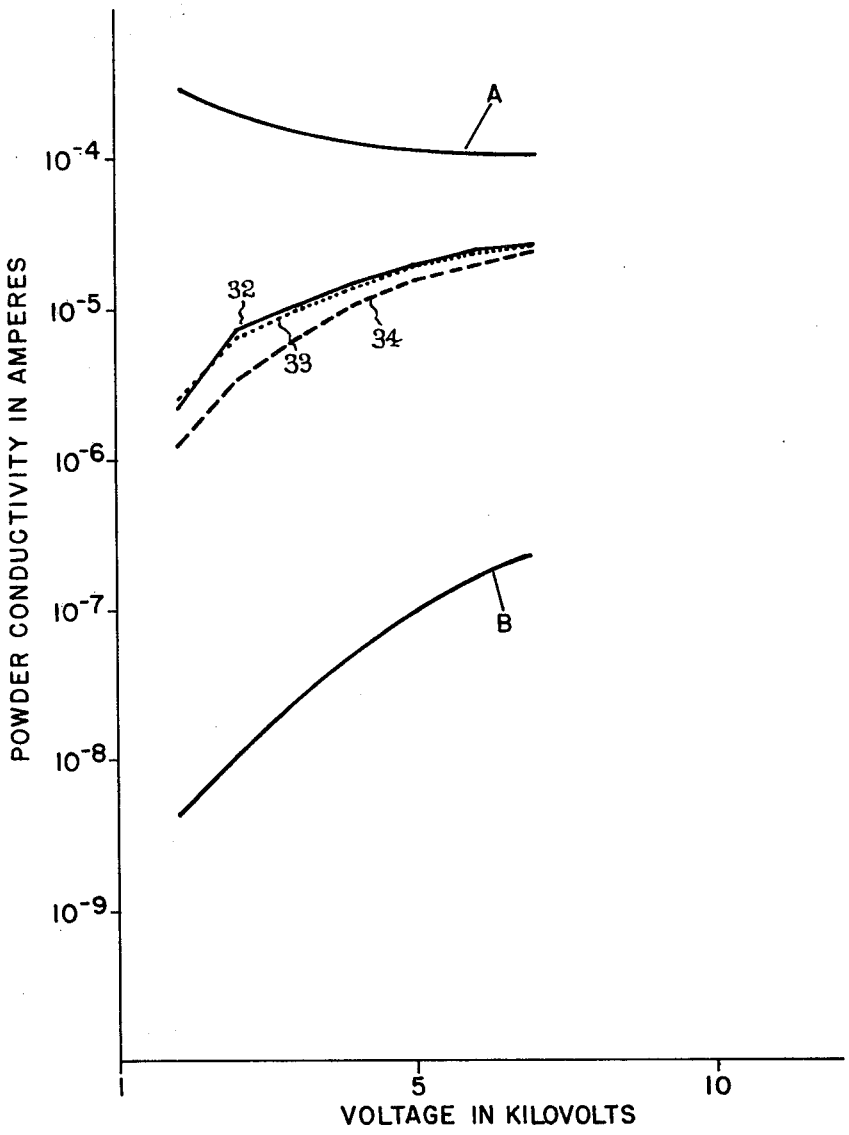
FIG. 2 is a graph illustrating the relationship between electrical conductivity and applied voltage for the powder mixtures of the present invention.

The proper range of electrical conductivity needed in the present powder mixture for electrostatic deposition providing the desired objectives is depicted graphically in FIG. 2. The electrical current which flows through a powder sample is related to the applied voltage across said powder sample as shown in said graph with suitable electrostatic deposition of a particular powder mixture being achieved when the electrical conductivity resides intermediate to curves A and B on said graph. Specifically, suitable electrical conductivity in the powder mixture exists at an applied voltage of 7 kilovolts when the current flow through the powder mixture lies in the range from $1\times10^{-4}$ to $2.3\times10^{-7}$ amperes whereas said current flow range is from $3\times10^{-4}$ to $4\times10^{-9}$ amperes when the applied voltage is 2 kilovolts. Current flow values below curve B on said graph signify too low an electrical conductivity in the powder mixture for suitable results in accordance with the present method. Likewise, current flows above curve A on the graph signify too high an electrical conductivity in the powder mixture for satisfactory results with the present coating process. Intermediate curve 32 on said graph represents the electrical conductivity measured for the powder mixture having 40 parts flux calcined diatomaceous silica, 60 parts fume silica, and 10 parts colloidal hydrophobic silica. Similarly, curve 33 represents the conductivity measurements obtained with a powder mixture having 60 parts flux calcined diatomaceous silica, 40 parts fume silica, and 10 parts colloidal hydrophobic silica whereas the final intermediate curve 34 represents said measurements obtained with a powder mixture having 50 parts calcined diatomaceous silica, 50 parts fume silica, and 10 parts colloidal hydrophobic silica.

Figure 3:
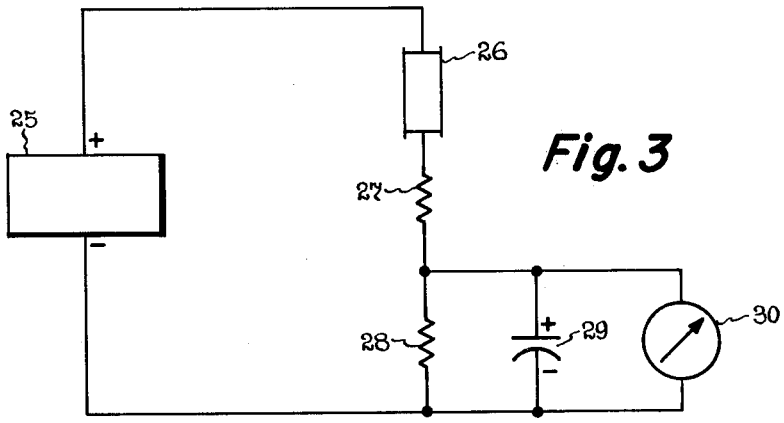
FIG. 3 is an electrical schematic diagram for measurement of electrical conductivity as reported at FIG. 2.

Said electrical conductivity measurements can be carried out with pressed pellets of a powder mixture having a cross sectional area of approximately 0.5 square centimeter and a thickness of about 0.25 centimeter. The pressed samples are prepared with a 7.5 kilogram loading pressure in a conventional manner. The electrical circuit used to make these conductivity measurements is depicted schematically in FIG. 3. Referring to FIG. 3, a suitable dc power supply 25 applies voltage directly to powder sample 26 across a pair of resistors 27 and 28. The capacitor element 29 and the amperage meter 30 complete the circuit arrangement to permit a direct reading of current flow through the powder sample at a predetermined applied voltage value.

It will be apparent from the foregoing description that improved electrostatic coatings for electric lamps have been provided to produce diffuse lamp emission. It will be apparent to one skilled in the art, however, that still further compositional modifications can be made in the powder mixture other than above specifically disclosed in order to enhance either electrostatic deposi-

ELECTROSTATIC SILICA COATING FOR ELECTRIC LAMPS

RELATED APPLICATION

In a co-pending U.S. patent application Ser. No. 239,595, also assigned to the assignee of the present invention, there is described a color electrostatic coating for electric lamps which utilizes a powder mixture of light refractive particles, a selective light absorption particulate colorant, and flux calcined diatomaceous silica to provide colored lamp emission. The color selective light absorption by the particular colorant in said powder mixture provides an effective filtering means whereby the balance of visible radiation produced by the light source is emitted from the lamp without further appreciable light loss. Said diffuse lamp coating can further serve to hide the filament effectively when employed on incandescent type lamps. A powder mixture useful in providing these improvements is fully characterized by having a Coulter particle size between 1 and 6 microns with electrical conductivity in range from $1\times10^{-4}$ to $2.3\times10^{-7}$ amperes at an applied voltage of 7 kilovolts and $3\times10^{-4}$ to $4\times10^{-9}$ at 2 kilovolts applied voltage.

BACKGROUND OF THE INVENTION

Electrostatically deposited coatings have been used for some time to provide diffuse light emission from incandescent lamps. For example, U.S. Pat. No. 4,081,709, also issued to the assignee of the present invention, describes electrostatic coating of silica on the inner bulb wall of incandescent lamps which is obtained by controlling the particle size and the electrical resistivity of the silica powder. The light diffusion produced in this manner completely hides the lamp filament and other internal lamp structure with little light loss and the aforementioned physical characteristics of the silica powder permit electrostatic deposition to be carried out reliably under varying environment conditions. On the other hand, the proper control of electrical conductivity in said silica powder mixture for uniform powder deposition by electrostatic coating can require addition to the powder mixture of various electrically conductive substances such as $H_2SO_4$, $SO_2$, NaCl, $Na_2SO_4$, NaOH or $Na_2O$ and triethylamine as well as heat treatment of the powder mixture itself or its constituents to reduce moisture content.

It would be understandably beneficial to eliminate such need of additives or heat treatment of the silica powder mixture in order to control the electrical conductivity for electrostatic deposition. If the silica powder mixture for such purpose is less sensitive to moisture content, then its shelf life should also be extended without appreciable agglomeration of the solid particulates. In addition, it would be desirable to achieve such modification in the silica powder mixture without significant cost increase or alteration of the electrostatic deposition process in order to produce a deposited coating having equivalent performance characteristics.

SUMMARY OF THE INVENTION

It is an important object of the present invention, therefore, to provide a light diffusion coating of silica for electric lamps which can be electrostatically deposited reliably in the same manner as the above mentioned U.S. Pat. No. 4,081,709. It is a further important object of the present invention to provide improved silica powder mixtures which are less moisture-sensitive as well as more stable during storage. The foregoing objects are achieved according to the present invention with a powder mixture comprising in parts by weight approximately 35–65 parts flux calcined diatomaceous silica, approximately 35–65 parts fumed silica, and approximately 5–15 parts colloidal hydrophobic silica, said powder having a Coulter particle size between 1 to 6 microns with electrical conductivity in the range from $1\times10^{-4}$ to $2.3\times10^{-7}$ amperes at an applied voltage of 7 kilovolts and $3\times10^{-4}$ to $4\times10^{-9}$ amperes at 2 kilovolts applied voltage. The diatomaceous silica constituent in the present powder mixture is commercially available as exemplified by the flux calcined grades of said material being sold under the trade name "Dicalite" by the General Refractories Company. For example, the flux calcined "White Filler" grade of said Dicalite filler material has been found particularly useful in a preferred coating of the present invention and other grades of this same material with the same particle size and bulk density characteristics would be expected to perform comparably so long as the moisture content in the material does not exceed about 1% by weight. The useful type fumed silica in the present powder mixture exhibits an electrical resistivity greater than $10^{12}$ ohm-centimeters and also does not have a moisture content exceeding about 1% by weight. A commercially available grade of fumed silica is available from Degussa Inc. being sold under the trade name "Ox-50" which has an ultimate particle size of about 0.05 microns along with a surface area in the range 40–70 square meters per gram, as measured by nitrogen absorption (B.E.T. method). A useful type colloidal hydrophobic silica for use in the present powder mixture is also commercially available and generally obtained by flame hydrolysis with particles varying in diameter between about 0.01 and 0.04 microns. In commercial preparation, silanol groups present on the surface area of the aerosol powder are reacted with dimethyl dichlorosilane to produce a hydrophobic nature for said material. A commercial grade of said product is sold by Degussa Inc. under the trade name "R972" with a surface area that resides in the approximate range 100–300 square meters per gram (B.E.T. method). The Coulter particle size characteristic in the present powder mixture is maintained between about 1 and 6 microns to provide an electrostatically deposited coating which exhibits adequate light diffusion (refraction), moderate back scattering (reflection), good adhesion and resistance to blow-off during subsequent lamp making operations.

In a preferred powder mixture of the present invention, improved light diffusion coating for an incandescent lamp is provided by mixing the above designated constituents in the proportions also specified using conventional techniques. Fluidization of said powder mixture during the electrostatic process can be altered by varying the proportions of the colloidal hydrophobic silica constituent with amounts less than about 5 parts by weight producing inferior fluidization and amounts greater than about 15 parts by weight producing a final coating with an inferior light scattering characteristic. An especially preferred powder mixture comprises 50 parts flux calcined diatomaceous silica, 50 parts fumed silica, and 10 parts colloidal hydrophobic silica which has been found to improve incandescent lamp quality in better lumen maintenance and longer life.

tion or lamp emission. For example, further adjustment of bulk density with powder mixture can be provided if greater fluidization is desired with a particular coating apparatus by using still other known silica fillers and extenders. Additionally, lamp emission in various colors can be obtained if a color pigment having suitable electrical conductivity and particle size characteristics is incorporated in the powder mixture. It is intended to limit the present invention, therefore, only by the scope of the following claims.

What we claim as new and desire to secure by United States Letters Patent is:

1. An electric lamp comprising a bulb having a light diffusing coating on the inside surface thereof comprising an electrostatically deposited powder comprising in parts by weight approximately 35–65 parts flux calcined diatomaceous silica, approximately 35–65 parts fumed silica, and approximately 5–15 parts colloidal hydrophobic silica, said powder having a Coulter particle size between 1 and 6 microns with electrical conductivity in the range from $1\times10^{-4}$ to $2.3\times10^{-7}$ amperes at an applied voltage of 7 kilovolts and $3\times10^{-4}$ to $4\times10^{-9}$ amperes at 2 kilovolts applied voltage.

2. The lamp of claim 1 wherein the moisture content of the fumed silica does not exceed about 1% by weight.

3. The lamp of claim 1 wherein the surface area for the fumed silica resides in the approximate range 40–70 square meters per gram.

4. The lamp of claim 1 wherein the surface area for the colloidal hydrophobic silica resides in the approximate range 100–300 square meters per gram.

5. The lamp of claim 1 wherein the electrical resistivity of the fumed silica exceeds $10^{12}$ ohm-centimeters.

6. The lamp of claim 1 wherein the moisture content and surface area of the flux calcined diatomaceous silica is less than that of the fumed silica.

* * * * *